US007556247B1

(12) United States Patent
Delfer et al.

(10) Patent No.: US 7,556,247 B1
(45) Date of Patent: Jul. 7, 2009

(54) PRINTER-LANE-PACKAGING FOR VARIABLE PAGE-COUNT DOCUMENT SETS

(75) Inventors: Frank W. Delfer, Granite Bay, CA (US); Charles B. Clupper, El Dorado Hills, CA (US); Brett J. Flickner, Folsom, CA (US)

(73) Assignee: DST Output West, LLC, El Dorado Hills, CA (US)

( * ) Notice: Subject to any disclaimer, the term of this patent is extended or adjusted under 35 U.S.C. 154(b) by 34 days.

(21) Appl. No.: 11/472,057

(22) Filed: Jun. 21, 2006

(51) Int. Cl.
*B41F 13/54* (2006.01)

(52) U.S. Cl. ..... 270/21.1; 270/1.01; 270/1.02; 270/20.1; 270/52.07; 270/52.09; 270/52.12

(58) Field of Classification Search ..... 270/1.01, 270/20.1, 21.1, 1.02, 39.01, 39.04, 39.07, 270/52.07, 52.09, 52.12
See application file for complete search history.

(56) References Cited

U.S. PATENT DOCUMENTS

| | | | | | |
|---|---|---|---|---|---|
| 3,586,437 | A * | 6/1971 | Dietz et al. | ..... | 399/76 |
| 4,179,107 | A * | 12/1979 | Harris | ..... | 270/4 |
| 4,279,410 | A * | 7/1981 | Bolza-Schunemann | ..... | 270/6 |
| 4,972,655 | A * | 11/1990 | Ogawa | ..... | 53/155 |
| 5,321,624 | A | 6/1994 | Helffrich et al. | | |
| 5,409,441 | A | 4/1995 | Muscoplat | | |
| 5,522,586 | A * | 6/1996 | Bennett et al. | ..... | 270/8 |
| 5,524,421 | A | 6/1996 | Nauheimer et al. | | |
| 5,754,434 | A | 5/1998 | Delfer et al. | | |
| 5,950,036 | A * | 9/1999 | Konishi | ..... | 399/8 |
| 5,960,607 | A | 10/1999 | Bohn et al. | | |
| 6,327,599 | B1 * | 12/2001 | Warmus et al. | ..... | 715/517 |
| 6,402,132 | B1 * | 6/2002 | Michaelis et al. | ..... | 270/1.01 |
| 6,402,136 | B1 * | 6/2002 | Lamothe | ..... | 271/185 |
| 6,446,100 | B1 * | 9/2002 | Warmus et al. | ..... | 715/246 |
| 6,615,105 | B2 * | 9/2003 | Masotta | ..... | 700/219 |
| 6,709,374 | B2 * | 3/2004 | Neubauer et al. | ..... | 493/405 |
| 6,880,818 | B2 * | 4/2005 | Desaulniers et al. | ..... | 270/52.14 |
| 2003/0146559 | A1 * | 8/2003 | Middelberg et al. | ..... | 271/9.01 |

* cited by examiner

*Primary Examiner*—Gene Crawford
*Assistant Examiner*—Leslie A Nicholson, III
(74) *Attorney, Agent, or Firm*—James M. Ritchey

(57) ABSTRACT

A system, apparatus, and method for printer-lane-packaging of documents utilizing a printer for printing on a linear web medium documents having fixed-data and variable-data information to produce in-lane formatting for each of the document and including a web cutter for cutting each of the in-lane printed documents into a stream of shingled sheets, a folder and collator for folding and collating the stream of shingled sheets into folded sets of variable page-counts per set for storage or immediate subsequent processing, and a computer for controlling the overall operation of the system components.

44 Claims, 6 Drawing Sheets

PRINTER-LANE-PACKAGING FOR VARIABLE PAGE-COUNT DOCUMENT SETS

BACKGROUND OF THE INVENTION

1. Field of the Invention

This invention pertains generally to a first-class mail production system or similar printing systems that permit a direct connection between a high-speed document printing process that utilizes "printer-lane-packaging" techniques to produce single to multi-page document package sets (variable page-count sets) and an envelope insertion and mailing process. More particularly, the subject invention relates to a system and a process for printing both form information and variable data information on printer-lane-generated documents that are subsequently cut, folded, and collated into individual document set packages having one or more pages per set in such a fashion that the resultant set packages may either directly or indirectly pass to a suitable envelope inserter for further post-printing processes, thereby combining two processes that traditionally have been completely separate entities and normally placed in different physical locations.

2. Description of Related Art

The exceedingly novel and non-obvious subject invention combines some elements of traditional direct mail processing with standard first-class mailing techniques and adds an overall new document processing sequence to create a reliable and efficient document package system for bulk mailings. Commercial printing practices routinely produce direct mail document packages that do not vary in the number of pages within each document package, in line with the printing process and achieve reliable rates, but do not attempt to fold, collate, and insert these sheets into envelopes or generate document packages which contain varied sheet counts per document package. Such direct mail identical sheets are commonly produced using commercial printing and finishing technology, where a high speed, high-tension paper web runs for hours without stopping. Downstream from the utilized printing units are positioned a slitter and a high-speed rotary cutter that convert the web into streams of shingled sheets that are then carried on a conveyor to a desired location. Subsequent processing equipment operates on these shingled streams of cut information-static sheets, typically doing aligning, trimming, and bundling. This approach reduces the likelihood of jams, allowing the equipment to run continuously for hours or even days. Thus, per-piece labor and capacity costs are low.

As will be described below in detail, the subject invention adds two further critical processing steps that are above and beyond those mentioned above to produce a highly flexible and integrated packaging system. First, the number of sheets per packaged piece may vary from as little as one sheet to as many as 20, 30, 100, or more. Second, each and every sheet is unique and must be accounted for and tracked. No existing direct mail production operation has ever achieved these two additional capabilities or constraints. Because of the complexity associated with meeting these two constraints, current practitioners of bulk first-class mail production have been forced to indirectly incorporate these two constraints into the chain of processing their mail by performing sheet-level processing (i.e., cutting, collating, and folding) off-line, away from the printer. This off-line approach prevents "exceptions" in the less reliable cutting, collating, and folding processes from stopping the printer. Instead, these processes are performed in-line with the inserter (see immediately below). This separation approach makes economic sense in an environment where printing assets are much more valuable than inserting assets, because the down-time capacity cost (i.e., depreciation) of a sheet jam at a quarter million dollar inserter is only a fraction of that of a sheet jam at a five million dollar printer.

As seen in FIGS. 1-3, the three distinct processes associated with existing mass-mailing of billing statements are shown. FIG. 1 depicts the traditional way in which standard fixed-data forms are generated, usually by an "outside" vendor ("outside" to the variable-data printing location and envelope insertion location).

Wide (36 inch) rolls of blank stock paper are run through a form printer to create a "web" of printed forms. The web containing the printed forms is slit down the middle and wound into two narrow rolls (each 18 inches wide). These 18 inch rolls are then stored for later use or used immediately. In any case, the 18 inch rolls of forms, eventually, are transported to the next piece of equipment for utilization.

FIG. 2 illustrates the standard variable data printing phase for traditional statement preparations. The 18 inch form rolls are transported to an unwinder, thereby producing, again, the relatively linear web of forms that was previously wound for storage and/or transport. The web then enters a variable data printing device. A web of forms now having variable data printed on them exits the variable data printing device and is fed into a stacker which normally fan-folds the final forms into stacks that are either stored or transported to the next piece of equipment for insertion into a mailing envelope.

FIG. 3 describes typical post-production (after variable-data has been printed on a standard fixed-data printed form) handling of statements. The stacked and fan-folded web is now cut into individual sheets that are then collated into specific individual sets, with each set being a customer's billing statement. The individual sets are then folded and passed to an inserter that generates the final in-envelope statements, with associated inserts. The final statements are delivered to appropriate mailing trays via an automatic trayer and then to the suitable mail carrier, such as USPS.

Thus, the existing prior art generally falls into two categories: 1) printing finishing systems that produce same-number-of-sheets sets of documents or 2) inserting systems that produce variable-number-of-sheets sets documents from already printed sheets. No combined systems are known to exist, therefore the subject invention that discloses a finishing system that produces variable-number-of-sheets sets of documents is novel and non-obvious.

U.S. Pat. No. 5,754,434 relates an integrated printing and inserting system in which two or more streams of sheets (i.e., bill detail sheets from one direction and a bill cover sheet from another direction) are merged into a collated package and then sent to a folder and from there to subsequent handling devices. The subject invention's "lane packaging" concept is not suggested or disclosed in the '434 patent.

Found in U.S. Pat. No. 5,321,624 is an insertions machine having a multiple document detector. Presented within this document is a means of thickness measurement for the purposes of exception detection and does not discloses any means or process of document generation.

U.S. Pat. Nos. 4,972,655, 5,409,441, 5,524,421, and 5,960,607 all disclose mailing finishing systems that produce, in a single run, same-number-of-pages sets of documents from a web press. It is once again stressed that the subject invention produces variable-number-of-pages sets of documents or same-number-of-pages sets of documents or a desired mixture of same or variable page count sets.

BRIEF SUMMARY OF THE INVENTION

An object of the present invention is to provide a system and method of operation that efficiently links traditional direct mailing techniques with bulk first class mailing procedures to eliminate the necessity of generating wasteful fan-folded stacks of documents that must then be unfolded for cutting, collating, and folding into customer-related sets.

Another object of the present invention is to furnish a system and procedure for sequentially utilizing a form printer followed by a lane-printing-capable variable-data printer to produce a stream of printed sheets that are immediately collated and folded into folded sets that are ready for storage or transport to a receiving inserter.

A further object of the present invention is to supply a system and procedure that employs a variable-data printer that generates, on pre-printed forms, documents via lane-printing procedures to produce a stream of shingled sheets that are collated and folded into variable page-count sets that may be stored or transported to a receiving inserter.

Still another object of the present invention is to disclose a procedure for producing collated, folded, and customer-related variable page-count sets of billing statements by utilizing a variable-data printer and printing-in-lane programming procedures.

Yet a further object of the present invention is to describe a method of producing inserter-ready folded sets of customer-related billing documents by eliminating wasteful intermediary fan-folding and unfolding steps via the use of printing-in-lane procedures to create a shingled stream of customer-related sheets that are then collated and folded into customer-related sets of billing documents having one of more pages.

It is stress that the examples provided herein are for a billing statement mailing system, but those skilled in the art will readily appreciate that any appropriate or equivalent documents may be printed with the disclosed system, apparatus, and method. Disclosed is a system, apparatus, and method for producing folded variable page-count sets of statements in a fast and efficient manner that utilizes a novel printing-in-lanes process that produces billing statements in a combined fixed-data printing, variable-data printing, and logically-related statement set collation process that eliminates the need for rolling up fixed-data printed forms, then un-rolling them to print the variable-data information, then fan-fold stacking and unstacking before the collator creates the logically-related statement sets. Comprising the subject system is a sequence of novel, efficient steps: 1) wide rolls of blank stock are unrolled and printed with fixed-data to produce a linear web of forms; 2) the web of forms is passed through a variable-data printer that utilizes "in-lane" printing techniques to generate a linear web of "in-lane" associated pages for eventual customer-related billing statements; 3) the linear web is cut into two or more shingled streams of pages; 4) as controlled by an overseeing program, each stream of shingled pages is passed to a folder/collator that groups customer-related pages together into variable page-count sets of folded billing statements; 5) the sets of folded billing statements are either stored for later processing or transferred to a suitable inserter; 6) the inserter accepts the sets of customer-related billing statements and handles them in an appropriate manner to produce final billing statements within an envelope; and 7) the enveloped statements are then placed in mailing trays and shipped by standard means.

Further objects and aspects of the invention will be brought out in the following portions of the specification, wherein the detailed description is for the purpose of fully disclosing preferred embodiments of the invention without placing limitations thereon.

BRIEF DESCRIPTION OF THE SEVERAL VIEWS OF THE DRAWING(S)

The invention will be more fully understood by reference to the following drawings which are for illustrative purposes only:

Figure 1:
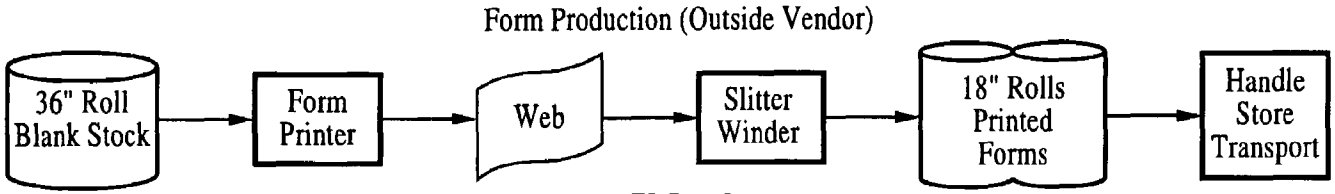
FIG. 1 (Prior Art)
FIG. 1 is a PRIOR ART flow diagram illustrating the traditional manner in which printed forms have been produced, usually at a remote location to that at which the forms are eventually utilized, starting with a standard wide roll of blank stock, printing on the unwound web of stock, then slitting the form printed web of stock in half, and rolling into two separate half-width form-printed rolls.
Figure 2:
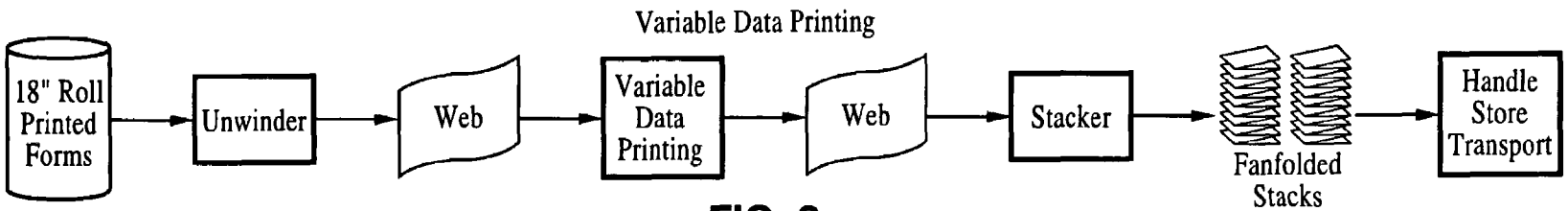
FIG. 2 (Prior Art)
FIG. 2 is a PRIOR ART flow diagram showing variable data printing on a half-width printed-form roll that is unwound into a web that passes through a variable-data printer with the produced web then fan-folded into stacks for storage or transport to subsequent process equipment.
Figure 3:
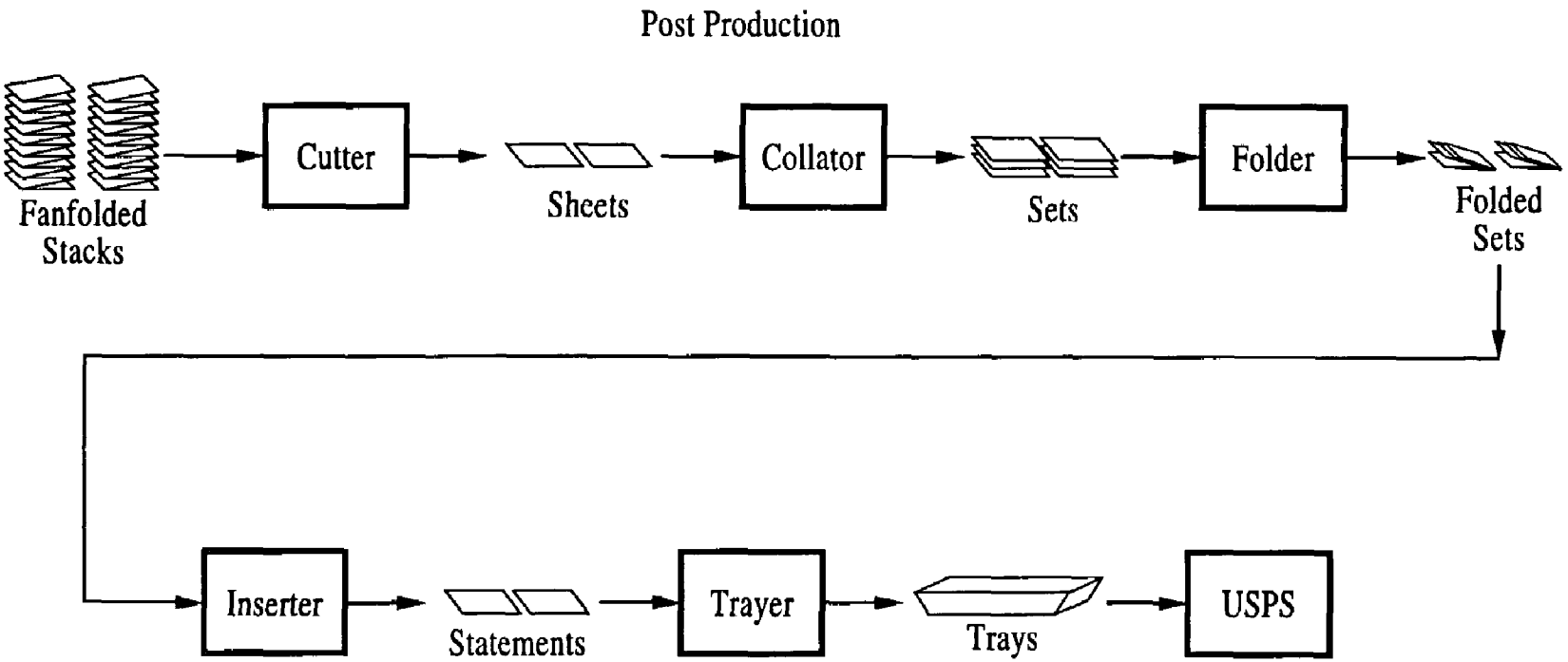
FIG. 3 (Prior Art)
FIG. 3 is a PRIOR ART flow diagram depicting post form and variable-data printing production steps that include unstacking the fan-folded web, cutting the web into individual sheets, collating the individual sheets into sets of customer-related document packages that are then folded and sent on to an envelope inserter for mail processing.
Figure 4:
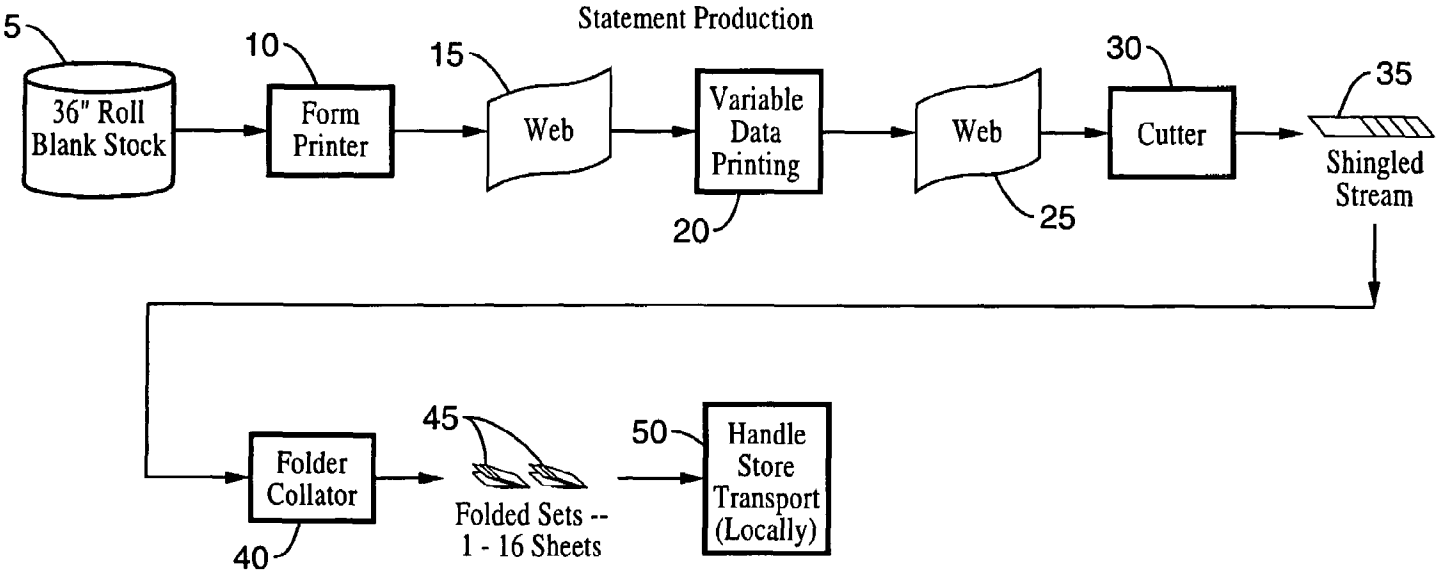

FIG. 4 is flow diagram for the subject invention system and process that discloses the starting with a standard wide roll of blank stock, printing fixed-form information on the unwound web of stock, printing variable-data on the form-printed web utilizing lane-printing procedures, and then slitting the generated web to produce a plurality of streams of shingled sheets that are immediately collated and folded to produce customer-related sets comprised of one of more sheets which are stored or transported to subsequent processing equipment, such as an envelope inserter.

Figure 5:
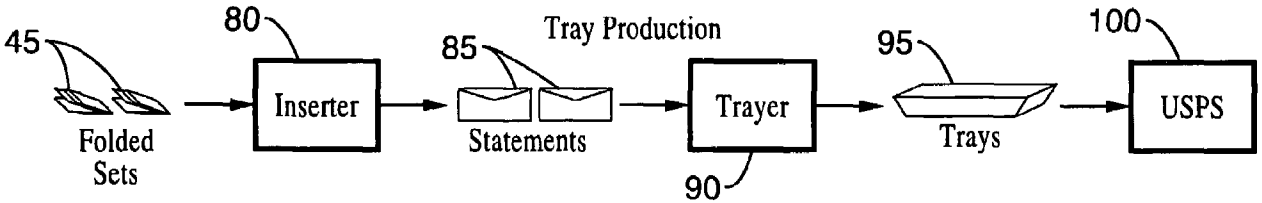

FIG. 5 is flow diagram for the subject invention system and process showing the folded customer-related sets, created in the system/process described in FIG. 4, entering an inserter to produce enveloped statements which are place into mailing trays and then mailed.

Figure 6:
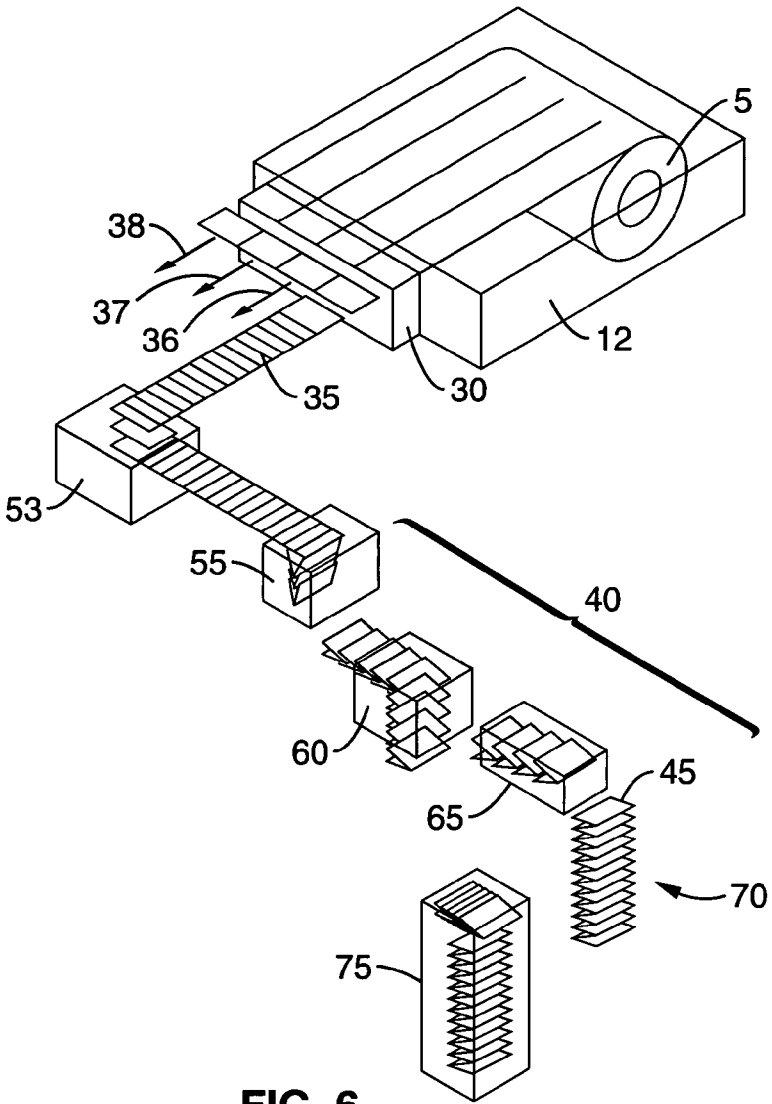

FIG. 6 illustrated an exemplary system for the subject invention in which a high-speed web printer produces, via in-lane printing procedures that captures all of the sheets for each customer within only one lane of printed sheets, a web with a plurality of lanes of fixed-form and variable-data printed documents that are immediately cut into separate streams of shingled sheets that are then folded, collated, and packaged for subsequent processing.

Figure 7:
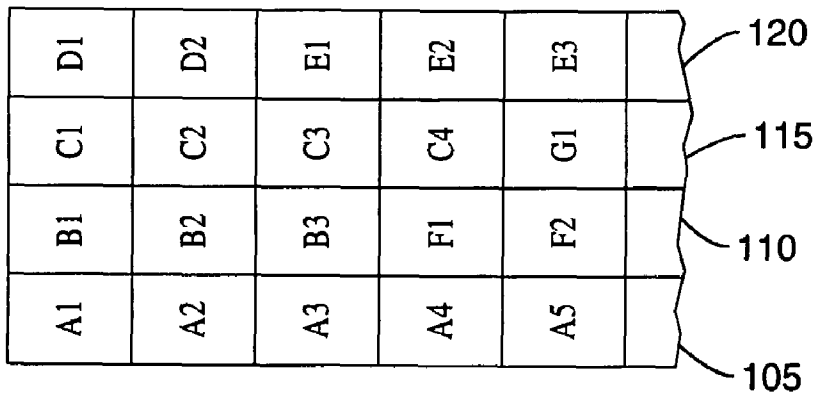

FIG. 7 depicts the output of an in-lane variable-data printed web of consumer-related sheets for the subject invention.

Figure 8:
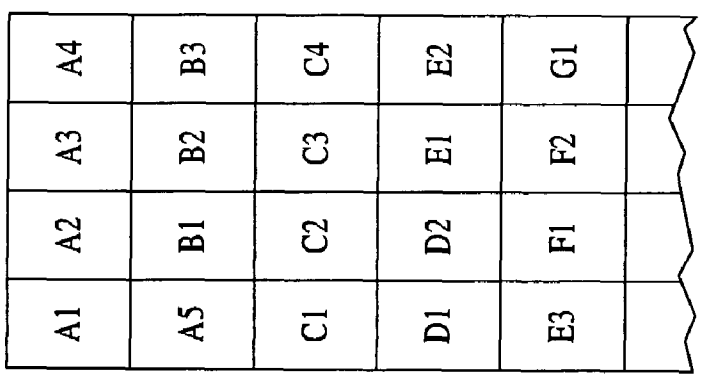
FIG. 8 (Prior Art)

FIG. 8 depicts the output of a traditional, PRIOR ART, variable-data printed web of consumer-related sheets.

Figure 9B:
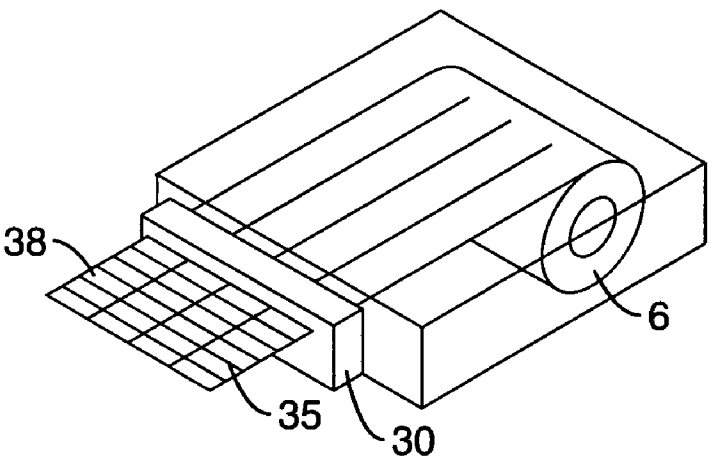
Figure 9A:
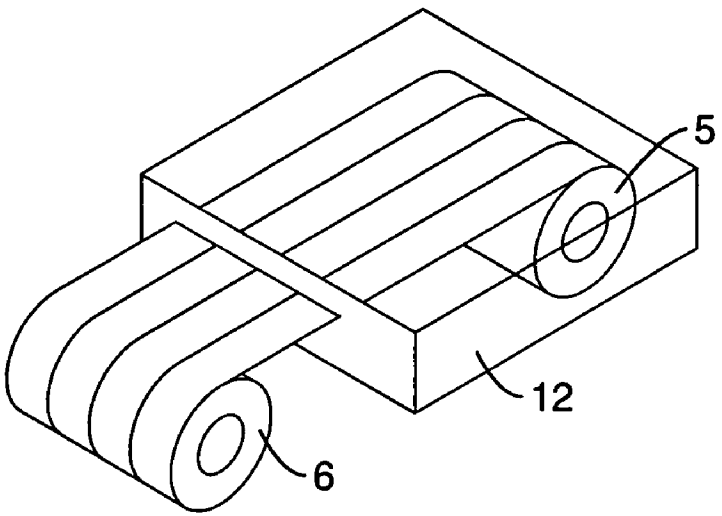

FIG. 9A shows an alternative embodiment of the subject invention in which the rolled blank stock 5 is first unrolled and printed via the suitable printing device 12 and then re-rolled 6 for subsequent processing.

FIG. 9B shows the printed and re-rolled web 6 (re-rolled in FIG. 9A) being cut 30 into desired shingled streams of pages 35 thru 38 for a "4-up" configuration.

DETAILED DESCRIPTION OF THE INVENTION

Referring more specifically to the drawings, for illustrative purposes the present invention is embodied in the apparatus generally shown in FIGS. 4-7. It will be appreciated that the apparatus may vary as to configuration and as to details of the parts, and that the method may vary as to the specific steps and sequence, without departing from the basic concepts as disclosed herein. The subject invention comprises a system and method for the efficient generation of first-class mailing items. For exemplary purposes only and not by way of limitation, the first-class mailing items will often be billing statements for services and products rendered to a consumer customer and may include additional inserts of various standard kinds that are placed within a mailing envelope by an inserter device. Each logically-related billing statement may vary from one to many pages/sheets (a variable page-count set) with each sheet usually having fixed-data form information and variable-data information printed on it. The fixed-date comprising information found on all of the sheets and not logically-related, while the variable-data comprises specific information such as name, address, services or products provided, monetary amount due, and the like. Further, each logically-related billing statement sheet contains machine-readable document-related indicia that may be detected by standard suitable sensors (LEDs, bar-code reading devices, video cameras, and the like) and relayed to an overseeing computer system. The overseeing computer system directs the operation of the subject system and interfaces with the various devices within the subject system via the suitable indicia-reading sensors positioned at appropriate locations within the subject invention's component parts.

Thus, disclosed is a system and method for producing folded sets of documents (billing statements being one example of such documents) in a fast and efficient manner that utilizes a novel printing-in-lanes process that produces documents in a combined fixed-data printing, variable-data printing, and logically-related document set collation process that eliminates the need for rolling up fixed-data printed forms, then un-rolling them to print the variable-data information, then fan-fold stacking and unstacking before the collator creates the logically-related document sets.

As can be seen in FIGS. 4 and 6, the subject document production portion of the subject process comprises obtaining wide rolls of blank stock 5 (normally standard 36 inch rolls, but other width dimensions are considered with the realm of this disclosure) are unrolled and printed with fixed-data 10 to produce a linear web of forms 15. The web of forms 15 is then passed through a variable-data printer 20 that utilizes "in-lane" printing techniques (see below for details as to the "in-lane" technique output) to generate a linear web of "in-lane" and customer-related billing pages 25 that will eventually be cut into sheets to generate the entire set of sheets that will become the billing statement for any particular customer. As seen specifically in FIG. 6, the fixed-data 10 and variable-data 20 printing processes may be combined within a suitable printing device 12. The linear web is cut 30 into two (a "2-up" printer), four (a "4-up" printer), or more shingled streams of pages (35 in FIGS. 4 and 35, 36, 37, and 38 in FIG. 6 for a "4-up" printer). The shingled sheets exit in streams that may proceed straight to subsequent processing steps or each stream may be turned 53 and angled to subsequent processing steps, whichever is desired for a particular setting.

As controlled by an overseeing program, each stream of cut, shingled sheets 35 (36, 37, 38) is passed to a folder/collator 40 that groups logically-related pages together into variable page-count sets of folded documents such as billing statements 45. The folder/collator 40 may be of various suitable configuration so long as folded variable page-count sets are produced. The variable page-count sets of folded documents 45 are either stored or transferred to a subsequent processing location 50. As seen in FIG. 6, the folder/collator 40 may comprise several components and is not limited to the depicted possible configurations.

More specifically, the folder/collator 40 seen in FIG. 6 comprises a buckle-folder 55 in which the shingled sheets 35 are folded and usually nested. A de-nester 60 then isolates the folded sheets so that the logically-related and variable page-count sets 45 can be generated in the collator 65 and stacked 70 in packaged variable page-count sets for storage or immediate use 50 in an inserter 80. It is noted that the stack of folded/collated variable page-count sets of logically-related statements may be placed in a suitably designed cartridge 75 to facilitate storage and later usage.

As related in FIG. 4, with use of the subject invention's in-lane printing procedure and set generation techniques, the mailing tray production process is now able to begin from the folded variable page-count sets of statements 45 and not the much more error-prone traditional fan-folded and still attached-to-one-another pages. With the subject invention, the inserter 80 accepts the sets of logically-related billing statements 45 and produces the filed statement envelopes 85, which are sent to the trayer 90 that fills the mailing trays 95 according to suitable postal regulations for mailing. Mailing in normally conducted by the USPS 100 or other appropriate agency.

For the sake of clarity, FIG. 7 illustrates the critical "in-lane" printing technique of the subject invention and FIG. 8 depicts the traditional left-to-right layout normally utilized in first-class mailing systems. FIG. 7 shows a "4-up" printed web of fixed-data/variable-date printed sheets in which each customer is identified by A, B, C, D, E, F, G, etc. and each sheet within a potential final set of customer-related sheets as 1, 2, 3, 4, 5, etc. As is clearly indicated, all pages within customer A's final statement are found only one lane 105 of sheets on the illustrated web and not in any of the other three lanes 110, 115, 120, as is true for each of the other customers. Thus, no cross or side-to-side mingling of sheets from one lane to any other lane is required to collate the final statement for any one customer. The traditionally side-by-side printing of statement sheets seen in PRIOR ART FIG. 8 has multiple customer sheet within each lane, thereby requiring extensive and time-wasting collation to generate a final statement for any particular customer.

FIGS. 9A and 9B illustrate an alternative embodiment of the subject invention in which the web of blank stock material 5 is first printed 12 and then re-rolled 6 before it is later processed via cutting 30 into shingled streams of pages 35 thru 38. This version of the invention may be utilized if the printed web 6 is to be moved or temporarily stored before the cutting process.

Although the description above contains many details, these should not be construed as limiting the scope of the invention but as merely providing illustrations of some of the presently preferred embodiments of this invention.

Therefore, it will be appreciated that the scope of the present invention fully encompasses other embodiments which may become obvious to those skilled in the art, and that the scope of the present invention is accordingly to be limited by nothing other than the appended claims, in which reference to an element in the singular is not intended to mean "one and only one" unless explicitly so stated, but rather "one or more." All structural, chemical, and functional equivalents to the elements of the above-described preferred embodiment that are known to those of ordinary skill in the art are expressly incorporated herein by reference and are intended to be encompassed by the present claims. Moreover, it is not necessary for a device or method to address each and every problem sought to be solved by the present invention, for it to be encompassed by the present claims. Furthermore, no element, component, or method step in the present disclosure is intended to be dedicated to the public regardless of whether the element, component, or method step is explicitly recited in the claims. No claim element herein is to be construed under the provisions of 35 U.S.C. 112, sixth paragraph, unless the element is expressly recited using the phrase "means for."

What is claimed is:

1. A system for printer-lane-packaging of logically-related document sets, wherein each document set has a variable number of pages, comprising:

a) means for producing a continuous stream of shingled in-lane formatted sheets comprising the logically-related variable page-count documents sets;

b) means for folding each said sheet within said shingled stream to produce a continuous stream of nested folded sheets;

c) means for collating said continuous stream of nested folded sheets into nested variable page-count document sets for storage or immediate subsequent processing; and d) means for controlling the overall operation of the system, wherein said controlling means interfaces with said producing, folding, and collating means for controlling, tracking, and assembling each of the logically-related variable page-count document sets as it progresses through the system.

2. A system for printer-lane-packaging of documents according to claim 1, wherein said folding means is a buckle-folder.

3. A system for printer-lane-packaging of documents according to claim 1, wherein said collating means includes means for de-nesting folded sheets.

4. A system for printer-lane-packaging of documents according to claim 1, wherein said system further including an inserter for accepting said variable page-count sets.

5. A system for printer-lane-packaging of logically-related document sets, wherein each document set has a variable number of pages, comprising:

a) means for printing in multiple lanes a continuous stream of pages that are logically-related to comprise document sets on a linear web medium to produce in-lane formatting for each said document set;

b) means for cutting said in-lane printed continuous stream of pages forming logically-related documents into a continuous stream of shingled sheets that are logically-related to each document set;

c) means for folding each said sheet within said shingled stream to produce a continuous stream of nested folded sheets;

d) means for collating said continuous stream of nested folded sheets into nested variable page-count document sets for storage or immediate subsequent processing; and e) means for controlling the overall operation of the system, wherein said controlling means interfaces with said printing, cutting, folding, and collating means for controlling, tracking, and assembling each of the logically-related variable page-count document sets as it progresses through the system.

6. A system for printer-lane-packaging of documents according to claim 5, wherein said printing means comprises:

a) a fixed-data printer and b) a variable-data printer.

7. A system for printer-lane-packaging of documents according to claim 5, wherein said printing means is a combined fixed-data and variable-data printer.

8. A system for printer-lane-packaging of documents according to claim 5, wherein said cutting means is a cutter that produces two streams of shingled sheets from said linear web medium.

9. A system for printer-lane-packaging of documents according to claim 5, wherein said cutting means is a cutter that produces four said streams of shingled sheets from said linear web medium.

10. A system for printer-lane-packaging of documents according to claim 5, further comprising means for changing a transport direction of said stream of shingled sheets.

11. A system for printer-lane-packaging of documents according to claim 5, wherein said folding means is a buckle-folder.

12. A system for printer-lane-packaging of documents according to claim 5, wherein said collating means includes means for de-nesting folded sheets.

13. A system for printer-lane-packaging of documents according to claim 5, wherein said system further including an inserter for accepting said variable page-count sets.

14. A system for printer-lane-packaging of logically-related document sets, wherein each document set has a variable number of pages, comprising:

a) means for printing in multiple lanes a continuous stream of pages that are logically-related to comprise document sets having fixed-data and variable-data information printed on a linear web medium to produce in-lane formatting for each said document set;

b) means for cutting said in-lane printed continuous stream of pages forming logically-related documents into a continuous stream of shingled sheets that are logically-related to each document set;

c) means for folding each said sheet within said shingled stream to produce a continuous stream of nested folded sheets;

d) means for collating said continuous stream of nested folded sheets into packaged variable page-count sets for storage or immediate subsequent processing; and e) means for controlling the overall operation of the system, wherein said controlling means interfaces with said printing, cutting, folding, and collating means and tracks each document as it progresses through the system.

15. A system for printer-lane-packaging of documents according to claim 14, wherein said printing means comprises:

a) a fixed-data printer and b) a variable-data printer.

16. A system for printer-lane-packaging of documents according to claim 14, wherein said printing means is a combined fixed-data and variable-data printer.

17. A system for printer-lane-packaging of documents according to claim 14, wherein said cutting means is a cutter that produces two streams of shingled sheets from said linear web medium.

18. A system for printer-lane-packaging of documents according to claim 14, wherein said cutting means is a cutter that produces four said streams of shingled sheets from said linear web medium.

19. A system for printer-lane-packaging of documents according to claim 14, further comprising means for changing a transport direction of said stream of shingled sheets.

20. A system for printer-lane-packaging of documents according to claim 14, wherein said folding means is a buckle-folder.

21. A system for printer-lane-packaging of documents according to claim 14, wherein said collating means includes means for de-nesting folded sheets.

22. A system for printer-lane-packaging of documents according to claim 14, wherein said system further including an inserter for accepting said variable page-count sets.

23. A system for printer-lane-packaging of logically-related document sets, wherein each document set has a variable number of pages and wherein each mailing document set has one or more sheets, comprising:

a) at least one multi-lane printer for printing each of the mailing documents with fixed-data and variable-data information on a linear web medium to produce in-lane formatting for each of the mailing document sets;

b) a cutter for cutting each said in-lane printed and logically-related variable page-count mailing document sets into at least one stream of continuous shingled sheets from said linear web medium, wherein said continuous stream of cut shingled sheets is still logically-related to each said variable page-count document set;

c) a folder for folding each said sheet within said shingled stream to produce a continuous stream of nested folded sheets;

d) a collator for collating said continuous stream of nested folded sheets into packaged variable page-count sets for storage or immediate subsequent processing; and e) a computer for controlling the overall operation of the system, wherein said controlling means interfaces with said printing, cutting, folding, for controlling, tracking, and assembling each of the logically-related variable page-count document sets as it progresses through the system.

24. A system for printer-lane-packaging of customer-related mailing document sets, with each set having a variable page-count, wherein each customer-related mailing document set has one or more sheets, comprising:

a) at least one multi-lane printer for printing each of the customer-related variable page-count mailing document sets with fixed-data and variable-data information on a linear web medium to produce in-lane formatting for each of the customer-related mailing documents set;

b) a cutter for cutting each said in-lane printed customer-related mailing document set into at least one stream of shingled customer-related sheets from said linear web medium, wherein said stream of sheets are logically-related to each document set;

c) a folder for folding each said customer-related sheet within said shingled stream to produce a continuous stream of nested folded sheets;

d) a collator for collating said continuous stream of nested folded customer-related sheets into packaged variable page-count sets for storage or immediate subsequent processing; and e) a computer for controlling the overall operation of the system, wherein said controlling means interfaces with said printing, cutting, folding, and collating means for controlling, tracking, and assembling each of the customer-related and logically-related variable page-count document sets as it progresses through the system.

25. A method for printer-lane-packaging of logically-related document sets, wherein each document set has a variable number of pages, comprising:

a) producing a stream of shingled sheets comprising each of the document sets printed with in-lane formatting on a multi-lane printer, wherein each sheet within said stream of shingled sheets is logically-related to the variable page-count document sets;

b) folding each said sheet within said shingled stream to produce a continuous stream of nested folded sheets;

c) collating said continuous stream of nested folded sheets into packaged variable page-count sets for storage or immediate subsequent processing; and d) controlling the overall operation of the system, wherein said controlling interfaces with said producing, folding, and collating for tracking and assembling each of the logically-related variable page-count document sets as it progresses through the system.

26. A method for printer-lane-packaging of logically-related document sets, wherein each document set has a variable number of pages, comprising:

a) printing in multi-lanes documents on a linear web medium to produce in-lane formatting for each document set having the variable page-count;

b) cutting each said in-lane printed document set into a stream of shingled sheets, wherein the stream of shingled sheets are logically-related to each final variable page-count document set to be assembled;

c) folding each said sheet within said shingled stream to produce a continuous stream of nested folded sheets;

d) collating said continuous stream of nested folded sheets into packaged variable page-count sets for storage or immediate subsequent processing; and e) controlling the overall operation of the system, wherein said controlling interfaces with said producing, folding, and collating for tracking and assembling each of the logically-related variable page-count document sets as it progresses through the system.

27. A method for printer-lane-packaging of documents according to claim 26, wherein said printing utilizes:

a) a fixed-data printer and b) a variable-data printer.

28. A method for printer-lane-packaging of documents according to claim 26, wherein said printing is performed by a combined fixed-data and variable-data printer.

29. A method for printer-lane-packaging of documents according to claim 26, wherein said cutting is performed by a cutter that produces two streams of shingled sheets from said linear web medium.

30. A method for printer-lane-packaging of documents according to claim 26, wherein said cutting is performed by a cutter that produces four said streams of shingled sheets from said linear web medium.

31. A method for printer-lane-packaging of documents according to claim 26, further comprising the step of changing a transport direction of said stream of shingled sheets.

32. A method for printer-lane-packaging of documents according to claim 26, wherein said folding is performed by a buckle-folder.

33. A method for printer-lane-packaging of documents according to claim 26, wherein said collating includes means for de-nesting folded sheets.

34. A method for printer-lane-packaging of documents according to claim 26, wherein said method further includes the step of accepting said variable page-count sets in an envelope inserter.

35. A method for printer-lane-packaging of mailing document sets, wherein each document set has a page-count that may vary from one document set to the next document set within a printing job, comprising the steps:

a) printing in multi-lanes mailing document sets with each set having fixed-data and variable-data information printed on a linear web medium to produce in-lane formatting for each said mailing document set, wherein each set has a variable page-count;

b) cutting each said in-lane printed mailing document set into at least one continuous stream of shingled sheets from said linear web medium, wherein each said document set having a variable page-count is logically-related within the continuous stream of shingled sheets;

c) folding each sheet within said stream of shingled sheets to produce a continuous stream of nested folded sheets;

d) collating said continuous stream of nested folded sheets into packaged variable page-count document sets for storage or immediate subsequent processing; and e) controlling by computer means the overall operation of said system, wherein said computer means tracks each mailing document as it progresses through said system and directs assembling each variable page-count document set with the proper number of pages.

36. A method for printer-lane-packaging of mailing documents according to claim 35, wherein said printing comprises:

a) printing said fixed-data with a first printer and b) printing said variable-data with a second printer.

37. A method for printer-lane-packaging of mailing documents according to claim 35, wherein said printing is carried out by a combined fixed-data and variable-data printer.

38. A method for printer-lane-packaging of mailing documents according to claim 35, wherein said cutting is by a cutter that produces two streams of said shingled sheets from said linear web medium.

39. A method for printer-lane-packaging of mailing documents according to claim 35, wherein said cutting is by a cutter that produces four streams of said shingled sheets from said linear web medium.

40. A method for printer-lane-packaging of mailing documents according to claim 35, further comprising the step of changing a transport direction of each said stream of shingled sheets.

41. A method for printer-lane-packaging of mailing documents according to claim 35, wherein said folding is carried out by a buckle-folder.

42. A method for printer-lane-packaging of mailing documents according to claim 35, wherein said collating includes de-nesting folded sheets.

43. A method for printer-lane-packaging of mailing documents according to claim 35, further comprising the step of inserting said variable page-count sets within mailing envelopes.

44. A method for printer-lane-packaging of customer-related mailing document sets having one or more sheets per each document set, comprising the steps:

a) printing the customer-related mailing documents sets, with each set having a variable page-count, on a linear web medium in multi-lanes with a first printer for fixed-data information and a second printer for customer-related variable-data information to produce in-lane formatting for each said customer-related mailing document, wherein all said sheets within each customer-related mailing document are in a single printed lane oriented with a document transport direction;

b) cutting each said in-lane printed customer-related mailing document set into at least one stream of continuous shingled customer-related sheets from said linear web medium, wherein each document set has a variable page-count determined by a number of pages required for each customer;

c) folding each sheet within said continuous stream of shingled customer-related sheets to produce a continuous stream of nested folded sheets;

d) collating said continuous stream of nested folded sheets into customer-related packaged variable page-count document sets for storage or immediate subsequent processing; and e) controlling by computer means the overall operation of said system, wherein said computer means tracks each customer-related mailing document as it progresses through said system and directs assembling each variable page-count document set with the proper number of pages for each customer.

* * * * *